US009964980B2

(12) United States Patent
Chiang et al.

(10) Patent No.: US 9,964,980 B2
(45) Date of Patent: May 8, 2018

(54) METHOD AND APPARATUS FOR OPTIMAL POWER FLOW WITH VOLTAGE STABILITY FOR LARGE-SCALE ELECTRIC POWER SYSTEMS

(71) Applicant: Bigwood Technology, Inc., Ithaca, NY (US)

(72) Inventors: Hsiao-Dong Chiang, Ithaca, NY (US); Bin Wang, Ithaca, NY (US)

(73) Assignee: Bigwood Technology, Inc., Ithaca, NY (US)

( * ) Notice: Subject to any disclaimer, the term of this patent is extended or adjusted under 35 U.S.C. 154(b) by 704 days.

(21) Appl. No.: 14/459,960

(22) Filed: Aug. 14, 2014

(65) Prior Publication Data

US 2016/0048150 A1 Feb. 18, 2016

(51) Int. Cl.
*G05F 1/66* (2006.01)

(52) U.S. Cl.
CPC ..... *G05F 1/66* (2013.01)

(58) Field of Classification Search
None
See application file for complete search history.

(56) References Cited

U.S. PATENT DOCUMENTS 7,343,360 B1 * 3/2008 Ristanovic ..... G06Q 30/08 705/412
2004/0158417 A1 * 8/2004 Bonet ..... H02J 3/00 702/57
2012/0179301 A1 * 7/2012 Aivaliotis ..... H02J 3/00 700/286
2013/0018517 A1 * 1/2013 Kalagnanam ..... G06Q 50/06 700/291
2014/0046493 A1 * 2/2014 Sun ..... G05B 15/02 700/286
2015/0051744 A1 * 2/2015 Mitra ..... G06Q 50/06 700/286

(Continued)

OTHER PUBLICATIONS

Wu et al., "A direct nonlinear predictor-corrector primal-dual interior point algorithm for optimal power flows", IEEE Transactions on Power Systems, vol. 9, No. 2, pp. 876-883, May 1994.

(Continued)

*Primary Examiner* — Tuan Dao
(74) *Attorney, Agent, or Firm* — The Law Office of Tong Lee

(57) ABSTRACT

An optimal power flow (OPF) problem formulates constraints and operation of an electric power system. A method and system is provided for generating a secure OPF solution that solves the OPF problem. A list of contingencies is created from system data. An OPF solution is computed for the electric power system to optimize an objective function value under the constraints of the electric power system. Voltage stability analysis is performed on the electric power system that operates in states represented by the OPF solution. Then the contingencies are ranked according to load margins of the electric power system. If there is at least an insecure contingency with a non-positive load margin in the list of contingencies, a set of preventive controls are computed and applied to control components in the electric power system. The method is performed iteratively to obtain the secure OPF solution.

20 Claims, 8 Drawing Sheets

(56) References Cited

U.S. PATENT DOCUMENTS

2015/0310366 A1* 10/2015 Yu ..... G06Q 50/06
705/7.22

OTHER PUBLICATIONS

Capitanescu et al, "Sensitivity based approaches for handling discrete variables in optimal power flow computations", IEEE Transactions on Power Systems, vol. 25, No. 4, pp. 1780-1789, Nov. 2010.

* cited by examiner

METHOD AND APPARATUS FOR OPTIMAL POWER FLOW WITH VOLTAGE STABILITY FOR LARGE-SCALE ELECTRIC POWER SYSTEMS

TECHNICAL FIELD

Embodiments of the present invention relate to the field of electric power generation and distribution systems. More specifically, embodiments of the present invention provide a method and apparatus for economic and secure operation of electric power generation and distribution systems.

BACKGROUND

The optimal power flow (OPF) is a subject of interest in power system operations, scheduling, and planning. The main objective of an OPF solver is to determine the optimal steady-state operation of an electric power system while satisfying technical and economic constraints. With the structural deregulation of electric power systems, OPF is becoming a basic tool in the power market. Existing solvers and programs for OPF computation are mostly focused on achieving an optimal solution to the study objective for the pre-contingency system (base case system); i.e., the electric power system without any security/stability considerations. However, it is crucial for the OPF solutions being not only economic and but also secure. The terms "secure" and "security" as used herein are interchangeable with the terms "stable" and "stability," respectively. More specifically, a power system is secure if it is able to maintain a normal and stable operation when encountering contingencies, where contingencies are discrete events such as failure of devices (e.g., lines, generators, shunts, etc.). A widely accepted system security concept is the so-called "N-1 security;" that is, only one device of the power network fails at a time for a single credible contingency. A contingency is "credible" if its occurrence is plausible and/or falls in a range of likelihood. The "N-1 security" contingency standard has been established by the North American Electric Reliability Corporation (NERC) and is required to be complied by power utilities. Accordingly, an electric power system is required to be operated in a way such that it can survive the occurrence of any single credible contingency where any single component in the system goes offline suddenly.

Mathematically, an OPF problem is modeled as a nonlinear programming (NLP) problem, which usually minimizes the total generation dispatch cost, transmission loss, or their combination subject to a set of equality and inequality constraints. From a computational viewpoint, an OPF problem is a large-scale non-convex NLP problem, in which both the objective function and constraint functions can be nonlinear. An OPF problem becomes a mixed-integer NLP when discrete control variables such as transformer taps, shunt capacitor banks and Flexible AC transmission system (FACTS) devices are taken into account. Furthermore, if transient stability constraints are considered, then an OPF problem can be expressed as a set of large-scale differential-algebraic equations (DAE).

An OPF problem can be formulated as a general constrained nonlinear optimization problem of the following form:

$$\min_{x=(x_s,x_c)} f(x_s,x_c)$$

$$s\cdot th(x)=0$$

$$g(x)\leq 0$$

$$x^l\leq x\leq x^u \quad (1)$$

where, $x_s=[\theta_1, \theta_2, \ldots, \theta_n, V_1, V_2, \ldots, V_n]^T$ is the state vector composed of variables of system running states including bus voltage amplitudes and phase angles; $x_c=[P_{g1}, P_{g2}, \ldots, P_{gm}, Q_{g1}, Q_{g2}, \ldots, Q_{gm}, tap_1, \ldots]$ is the control vector which is composed of control variables such as generator real and reactive power outputs, transformer taps, shunt capacitor banks, FACTS control variables, and so on; g(x) represents nonlinear equality constraints required for power flow balance at each bus; h(x) represents nonlinear inequality constraints composed of functional and operational constraints such as power flow limits over transmission lines and transformers, limits on VAR (voltage-ampere reactive, which is a unit used to measure reactive power in an AC electric power system) injections for reactive control buses and real power injections for the slack buses; $x^l$ and $x^u$ are the lower and upper bounds to be imposed on state and control variables.

There has been a wealth of research efforts focused on developing effective and robust nonlinear programming (NLP) methods for solving general nonlinear optimization problems of the form (1) and applications of these methods to solving OPF problems with a full set of nonlinear equality and inequality constraints. Existing methods for solving OPF problems either through solving an approximated linear program (LP) or through solving the NLP directly. LP based solvers are generally fast and very robust. However, since the LP is only an approximate to the true OPF problem, the resulting LP solutions can be an inaccurate approximate to the true OPF solution. Moreover, some information, such as the locationally marginal prices (LMP) that is required by power markets cannot be accurately obtained. NLP based solvers, on the other hand, can result in accurate OPF solutions and LMP values, at the expense of increased solver complexity and decreased solver robustness. More specifically, due to the nonlinearity and nonconvexity of the objective and constraint functions of the OPF problem, the convergence of the solver is usually not guaranteed, even though an OPF solution indeed exists. When security criteria are satisfied for the OPF solution, the resulting optimization problem becomes security-constrained optimal power flow (SCOPF). Therefore, the goal of an SCOPF problem is to ensure that the system operate properly under both the pre-contingency (base case system) and post-contingency conditions. Existing SCOPF methods usually try to solve an augmented OPF problem to co-optimize among the involved contingences. Complexity, in terms of the number of decision variables and the number of equality and inequality constraints, of the resulting OPF problem grows rapidly as the number of contingencies under study increases. However, such increased complexity could result in numerical issues including poor convergence, rapidly increased consumption of CPU time and other computational resources. For example, in order to perform a security-constrained OPF analysis on a 10,000-bus system with 100 contingencies, the augmented OPF problem to be solved will have millions of variables and nonlinear constraints. Therefore, the augmented OPF problem can easily become intractable or even impossible by the available computational resources as the scale of the system or the number of contingencies increases.

SUMMARY

According to one embodiment of the invention, a method is provided for generating generates a secure optimal power flow (OPF) solution for solving an OPF problem that formulates constraints and operation of an electric power system. The method comprises the steps of (a) creating a list of contingencies from system data; (b) computing an OPF solution for the electric power system to optimize an objective function value under the constraints of the electric power system; (c) performing voltage stability analysis on the electric power system that operates in states represented by the OPF solution to rank the list of contingencies according to load margins of the electric power system; (d) if there is at least an insecure contingency with a non-positive load margin in the list of contingencies, computing a set of preventive controls, which are adjustments to parameters of control components in the electric power system; and (e) applying the set of preventive controls to the control components in the electric power system. The steps of (b), (c), (d) and (e) are repeated to obtain the secure OPF solution.

In another embodiment, a system is provided for generating a secure OPF solution for solving an OPF problem that formulates constraints and operation of an electric power system. The system comprises a memory to store an OPF solver and a voltage stability analyzer, and one or more processors coupled to the memory. The one or more processors are adapted to (a) create a list of contingencies from system data; (b) compute an OPF solution for the electric power system to optimize an objective function value under the constraints of the electric power system; (c) perform voltage stability analysis on the electric power system that operates in states represented by the OPF solution to rank the list of contingencies according to load margins of the electric power system; (d) if there is at least an insecure contingency with a non-positive load margin in the list of contingencies, compute a set of preventive controls, which are adjustments to parameters of control components in the electric power system; and (e) apply the set of preventive controls to the control components in the electric power system. The one or more processors are further adapted to repeat the operations of (b), (c), (d) and (e) to obtain the secure OPF solution.

In yet another embodiment, a non-transitory computer readable storage medium includes instructions that, when executed by a processing system, cause the processing system to perform the aforementioned method for generating a secure OPF solution for solving an OPF problem that formulates constraints and operation of an electric power system.

BRIEF DESCRIPTION OF THE DRAWINGS

Embodiments are illustrated by way of example and not limitation in the Figures of the accompanying drawings.

DETAILED DESCRIPTION

Figure 1:
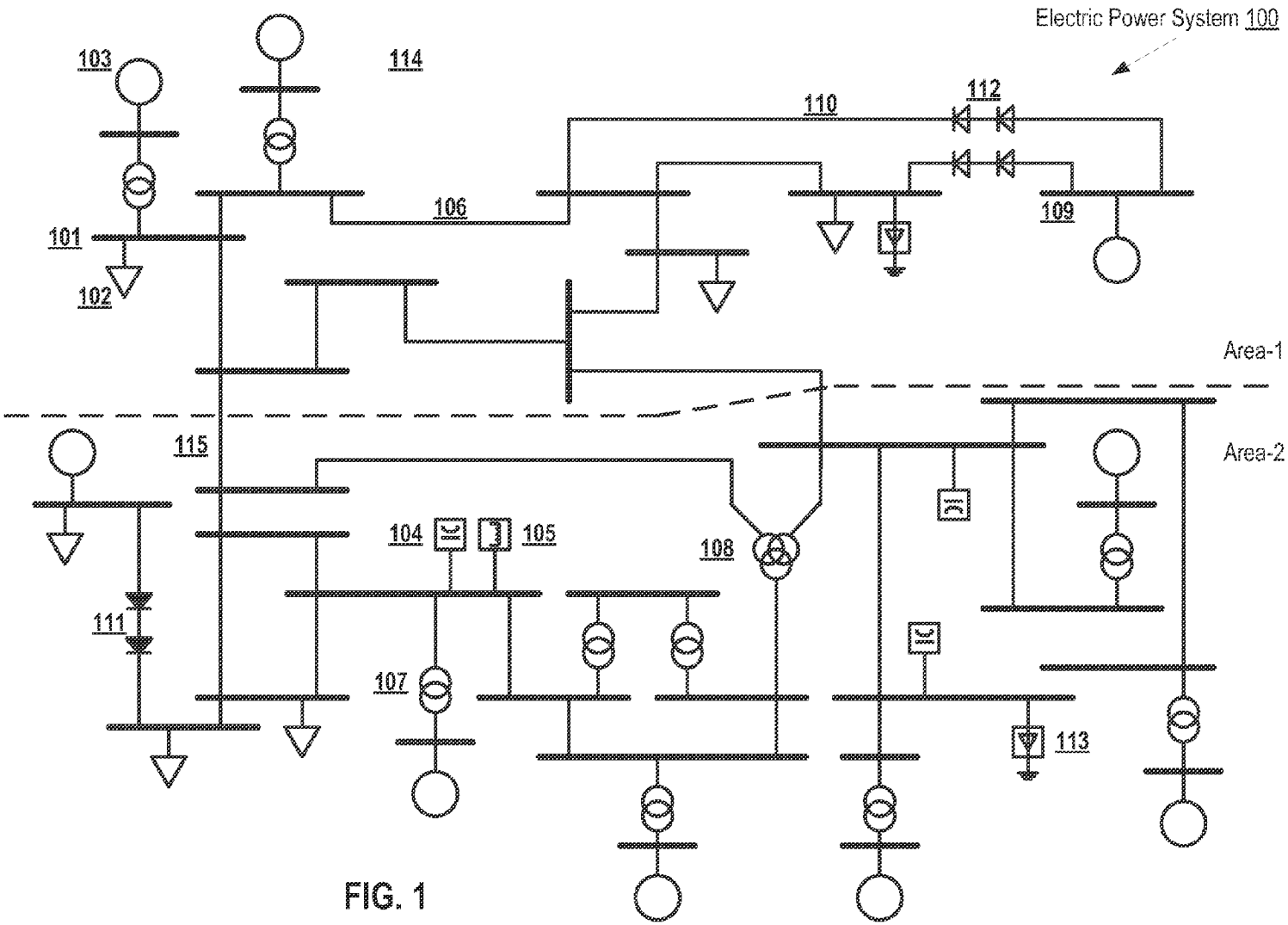
FIG. 1 is a diagram illustrating an electric power system according to one embodiment.

The aforementioned issues of existing practices for solving the OPF and security-constrained OPF problems motivate the development of a SuperOPF-VS process. The SuperOPF-VS process computes secure optimal power flow solutions by incorporating a SuperOPF process for optimal power flow computation and a voltage stability (VS) process for voltage stability analysis. The SuperOPF-VS process achieves at least the following goals: 1) to avoid solving the difficult, if not impossible, OPF problem with augmented dimensions; 2) to take full advantage of existing mature voltage stability analysis tools for fast voltage stability analysis; and 3) to realize an OPF problem with voltage stability that scale well with the number of contingencies; that is, the complexity of the OPF problem does not increase when the number of contingencies increases, such that the OPF problem is scalable to handle large contingency lists for large-scale electric power systems.

Embodiments of present invention provide a method and apparatus for generating voltage stability analysis-assisted optimal power flow for large-scale electric power systems. The method and apparatus performs a SuperOPF-VS process, which is an iterative process that combines a SuperOPF process for computing an optimal power flow solution and a VS process for analyzing voltage stability with respect to a list of contingencies for the optimal power flow solution. The VS process also computes a set of optimal preventive controls to eliminate or reduce insecure contingencies.

Embodiments of the SuperOPF-VS process have at least the following advantages. One advantage of the SuperOPF-VS process is that it includes all of the advantageous features of full nonlinear optimization methods and yet it is more efficient than these methods. Examples of the full nonlinear optimization methods include accurate OPF solution and LMP calculation, which are generally more favorable than linear programming (LP) based OPF and security-constrained OPF methods. The SuperOPF-VS process is efficient because it does not deal with the whole list of thermal limit constraints (which is typically twice the number of branches in the system). Instead, the SuperOPF-VS process only deals with active thermal limit constraints (e.g., usually less than 100) in order to compute an OPF solution.

Another advantage of the SuperOPF-VS process is that it is efficient as it does not use all of the thermal limit constraints (e.g., only the active thermal limit constraints is used) in computing an OPF solution.

Yet another advantage of the SuperOPF-VS process is that discrete controls are efficiently handled with a sensitivity-based method. Therefore, all controls in the system can be assigned to their physically allowed positions.

Yet another advantage of the SuperOPF-VS process is that it is able to tackle a large number of contingencies on large-scale electric power systems. This is because the SuperOPF process is performed on the base case system without considering the effect of the contingencies. The contingencies are analyzed in a separate process, i.e., the VS process.

Yet another advantage of the SuperOPF-VS process is that it provides useful indices for a system operator to evaluate the effects introduced by enforcing voltage stability constraints. These indices are readily available or can be derived conveniently as a result of the Super-OPF process. More specifically, both the OPF objective and load margins for the system are available as a result of the Super-OPF process. Moreover, the SuperOPF process can provide an exact upper bound on the optimality of the solution produced by the VS process, thus explicit indices such as the changes of the OPF objective and load margins can be conveniently derived for evaluating the conservativeness and other effects introduced by enforcing voltage stability constraints.

Before describing the SuperOPF-VS process, it is useful to show an example of an electric power grid (or also referred to an electric power network or electric power system) to which the SuperOPF-VS process can apply to improve its power flow. FIG. 1 illustrates an electric power system 100 according to one embodiment. The system 100 is an interconnected network for delivering electricity from suppliers to consumers. The system 100 includes generating stations that produce electric power, high-voltage transmission lines that carry power from distant sources to demand centers, and distribution lines that connect individual consumers.

An alternating-current (AC) bus 101 represents a node in the graph of the power network. All or a subset of the following control components can be defined for a bus in the network. Additional control components may also be included in alternative embodiments of an electric power network.

Load 102: a component that consumes both active power (measured in MW, represented as P_D) and reactive power (measured in MVar, represented as Q_D).

Generator 103: a component that produces both active power (Measured in MW, represented as P_G) and reactive power (measured in MVar, represented as Q_G).

The voltage magnitude and phase angle of bus 101: represented as V and θ, respectively. The voltage magnitude of bus 101 is usually restricted to a certain range around a nominal value.

Shunt capacitor 104 or inductor 105: The voltage magnitude and phase angle are controls defined for every bus in the network, while the other controls, namely, load, generator and shunt, are optional. In one embodiment of the OPF study, the main parameters to be considered for an AC bus 101 are the bounds for the voltage magnitude and phase angle and the bounds for load 102, generator 103, shunt capacitor 104 and inductor 105.

An AC line or branch 106 represents an arc in the network graph, which transmits both active and reactive power between the two attached AC buses 101 in both directions. The following controls and states are associated with an AC branch 106:

Power flow: is defined as the active and reactive power injected into the AC branch 106 by both AC buses 101 attached to it.

Adjusted impedance: represents the branch impedance adjusted by an attached transformer 107. This control is optional.

An AC transformer 107 is an extra transformer to an AC branch 106, which my may either transform the voltage magnitude at the attached AC buses 101, or shift the difference between the voltage phase angles of the attached AC buses 101 (also called phase shifter). An AC transformer can connect two AC buses (namely, two-phase transformer 107) or three AC buses (namely, three-phase transformer 108). An OPF solver usually converts the three-phase transformer 108 to three two-phase transformers 107, each of which connects a pair of the attached AC buses.

In one embodiment of an OPF solver, the main parameters to be considered for an AC branch are its admittance (with the conductance component and the susceptance component) and the flow capacity ratings (that is, the minimum and maximum total flows through the AC branch that is constrained by the thermal ratings). For an AC transformer 107, extra controls and states needed to be considered include tap choice, tap turn ratio (for a normal transformer), and tap phase shift (for a phase shifter). Extra parameters, namely, bounds for the tap turn ratio and tap phase shift also need to be involved in some embodiments of the OPF study.

In addition to AC buses, there can also be direct-current (DC) buses in the power network. A DC bus 109 represents a node in the network graph of the power system that is represented by DC voltage and DC current injection. Accordingly, the main parameters for a DC bus 109 include the bounds for the DC voltage and current. A DC line (or branch) 110 is represented as an arc in the network graph of the power system that transmits a constant current in the network. A DC line 110 is represented by its DC current and the main parameter is its resistance.

Converters are used to connect AC and DC buses. Converters can be an AC-DC converter (a rectifier) 111 or a DC-AC converter (inverter) 112. Parameters to be considered in an embodiment of the OPF study for a converter include bounds for all converter controls and states, and the communicating impedance.

Flexible AC transmission system (FACTS) devices 113 can be used in the electric power network to enhance controllability and increase power transfer capability of the network. A FACTS device 113 is a power electronic based system and other static equipment that provide control of one or more AC transmission system parameters. FACTS devices 113 are not modeled as distinct components in the OPF study, but rather impose tight bounds on certain controls or states of the regulated network components.

Finally, an OPF study is generally carried out for a part of the whole power network, namely, an area 114, which is defined as a group of buses used for defining area power exchange and inter-area power transfer limits. The area 114 generally involves several interfaces which are groups of branches 115 to connect one area to another.

Figure 2:
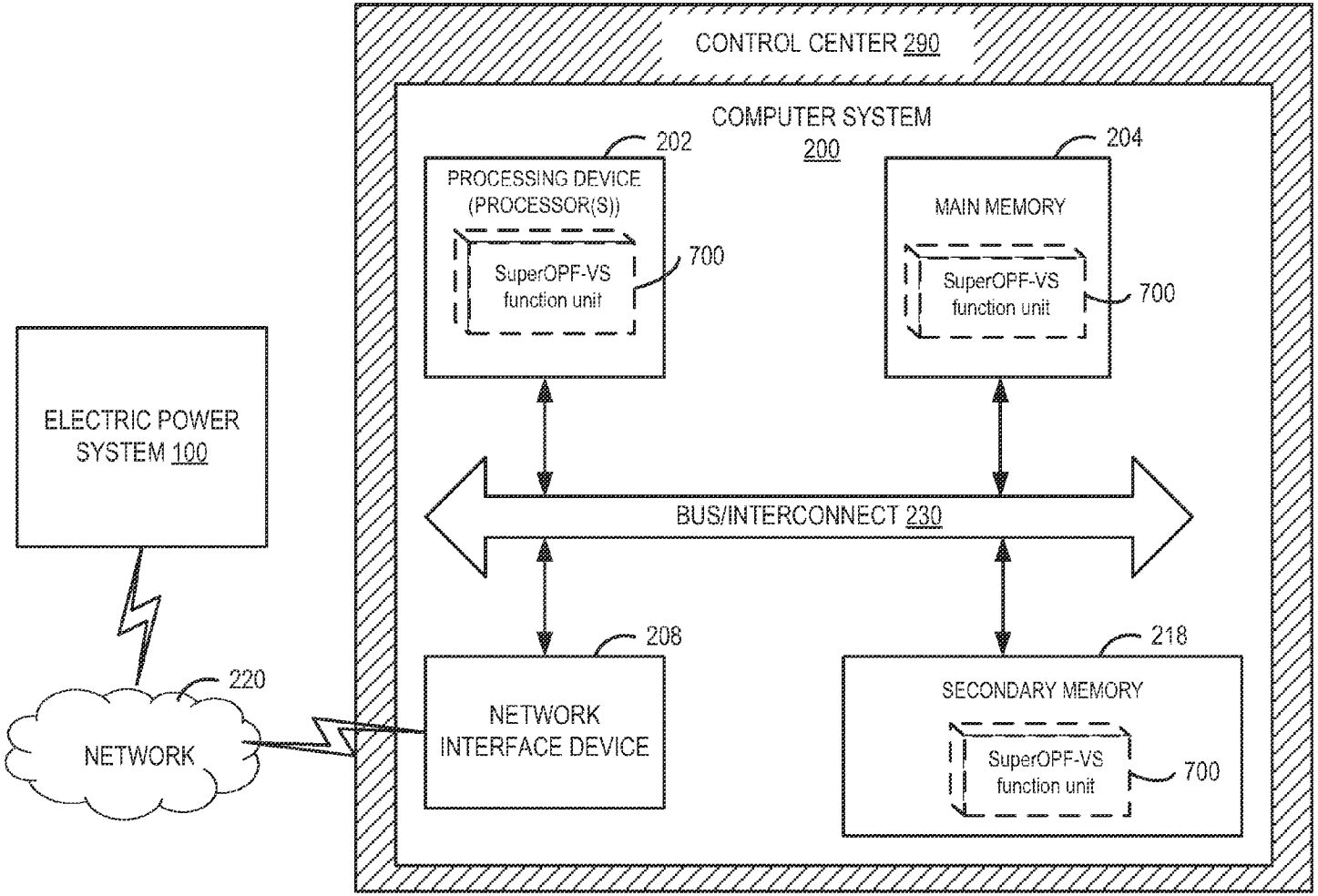
FIG. 2 is a block diagram illustrating an example of a computer system according to one embodiment.

A SuperOPF-VS process is an iterative process which combines a SuperOPF process for computing an OPF solution and a VS process for analyzing voltage stability based on a list of contingencies. A set of optimal preventive controls is computed and applied to the system to eliminate or reduce insecure contingencies. In some embodiments, the SuperOPF-VS process is performed by one or more control centers coupled to the electric power system (e.g., the electric power system 100 of FIG. 1). In one embodiment, the control centers may be distributed across a geographic region. The one or more control centers may be coupled to the electric power system 100 via a communication network, such as a wired network, wireless network, private network, public network, or any combination of the above. FIG. 2 illustrates an example of a control center 290 that includes at least a machine in the form of a computer system 200 within which a set of instructions, for causing the machine to perform any one or more of the processes and/or methodologies discussed herein, may be executed. The computer system 200 will be described in further detail at the end of the description.

An implicit integration process is described herein for integrating optimal power flow computation and voltage stability analysis. During the implicit integration, the imposed security constraints are represented implicitly, and the dimension of the OPF problem remains the same. The implicit integration can be performed as an iterative procedure of OPF solving followed by voltage stability checking. A set of preventive controls may be applied to reduce or eliminate insecure contingencies.

Figure 3:
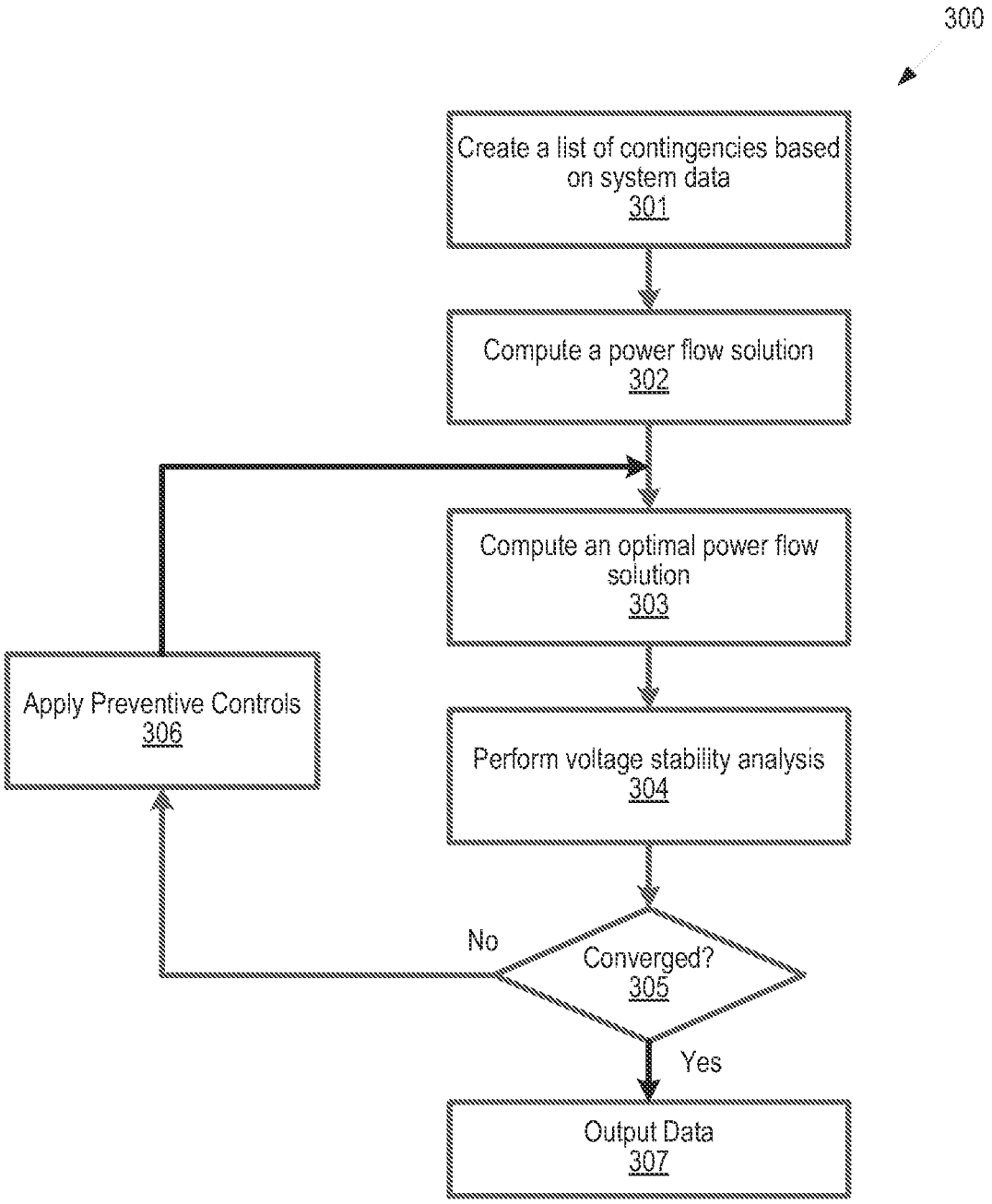
FIG. 3 illustrates an iterative procedure based on implicit integration according to one embodiment.

FIG. 3 illustrates an iterative procedure 300 based on the implicit integration according to one embodiment. The iterative procedure 300 includes the following steps.

Step 1: Based on system data from an electric power system, create a list of contingencies (301).

Step 2: Compute a power flow (PF) solution using a power flow solver (e.g., the Gauss-Seidel method, the Newton-Raphson method, the fast decoupled method, etc.) on the base case system (302).

Step 3: Compute an OPF solution using an OPF solver (e.g., the SuperOPF process to be described with reference to FIG. 5) on the base case system (303).

Step 4: Perform voltage stability analysis based on the list of contingencies over the OPF solution using a VS tool (304).

Step 5: Determine whether the process converges based on a set of stopping criteria (305). If the process is not converged (which means there are insecure contingencies found by the VS tool, which further means that these contingencies have negative load margins), compute an optimal set of preventive controls for eliminating or reducing the insecure contingencies, and proceed to step 6; otherwise, proceed to step 7.

Step 6: Apply the preventive controls to the system (306), and return to step 3.

Step 7: Terminate the process and report the output data (307).

Figure 4:
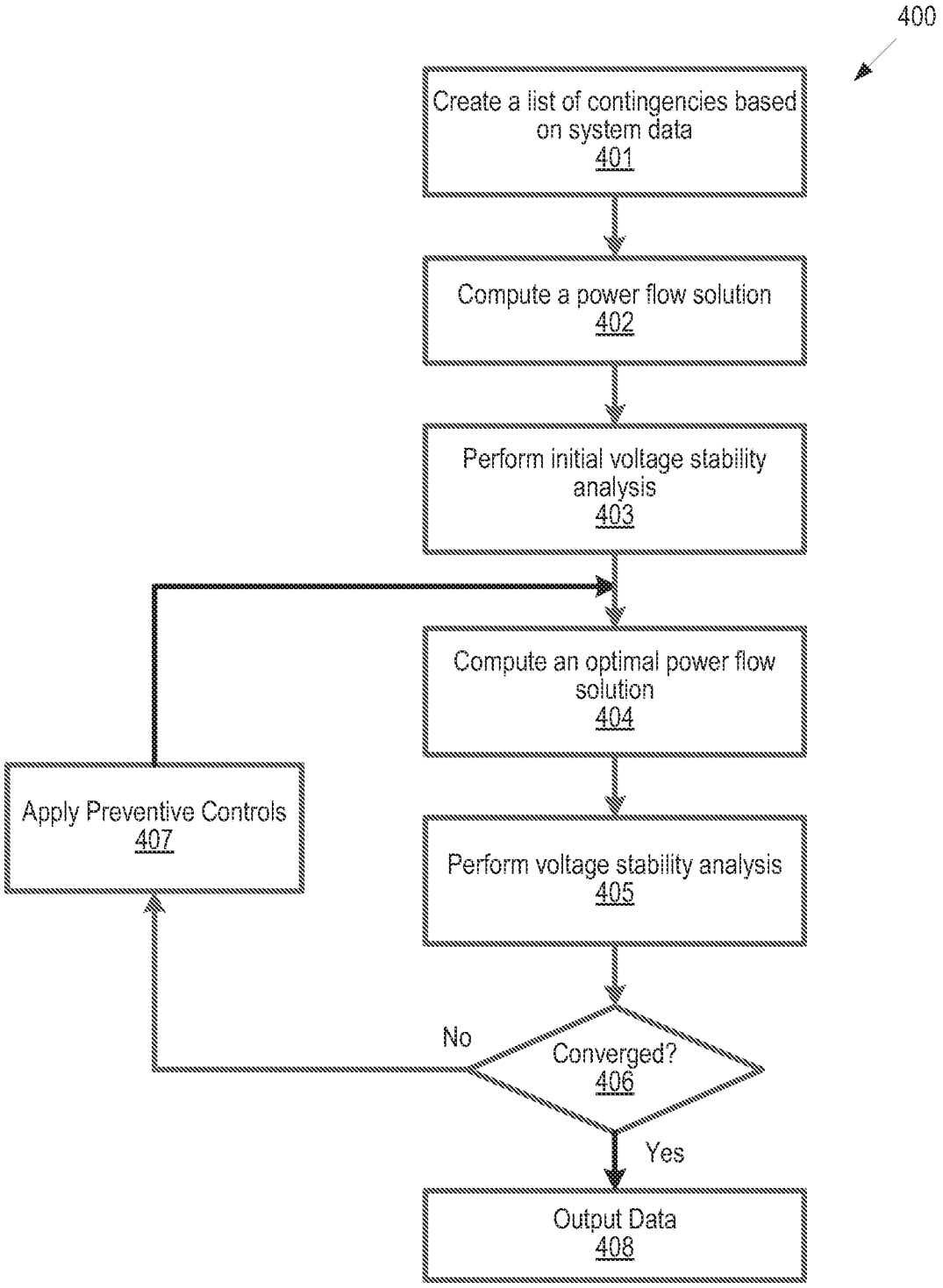
FIG. 4 illustrates an example of a SuperOPF-VS process according to one embodiment.

In one embodiment, the SuperOPF-VS process to be described herein incorporates the implicit integration for voltage-stability-assisted optimal power flow analysis. Referring to FIG. 4, a SuperOPF-VS process 400 according to one embodiment incorporates the implicit integration process into an iterative procedure that includes a combination of a SuperOPF process and a VS process. The SuperOPF-VS process 400 includes the following steps according to one embodiment.

Step 1: Based on system data from an electric power system, create a list of contingencies (401). The contingencies created herein are credible contingencies.

Step 2: Compute an initial power flow solution by a power flow solver (402). The initial power flow solution is fed to an initial VS process (403). The initial VS process carries out contingency ranking to rank the list of contingencies. The contingency ranking indicates the security status of the base case system.

Step 3: Apply a SuperOPF process to the system using the initial power flow solution as the initial point. Compute an OPF solution for the base case system, resulting in a base case optimal power flow solution which minimizes or maximizes a given objective function while all operational and physical limits of the system are satisfied (404).

Step 4: The OPF solution computed by the SuperOPF process is fed into the VS process, and contingency ranking is carried out on the list of contingencies. The contingency ranking result shows the security status of the OPF solution (405).

Step 5: Determine whether the process converges (406). If the process is not converged, compute an optimal set of preventive controls and proceed to step 6; otherwise, proceed to step 7. The process converges if one or more of the following stopping criteria are satisfied: 1) the OPF solution is secure (i.e., there is no insecure contingency), 2) the change of OPF objective is within a threshold and the list of insecure contingencies stays unchanged in two consecutive iterations, 3) the maximum number of iterations is reached.

Step 6: Apply the optimal set of preventive controls computed by the VS process to the base case system and compute a new power flow solution (407). Use this new power flow solution as the initial point, and return to step 3.

Step 7: Terminate the SuperOPF-VS process, and output the computation results (408).

Figure 5:
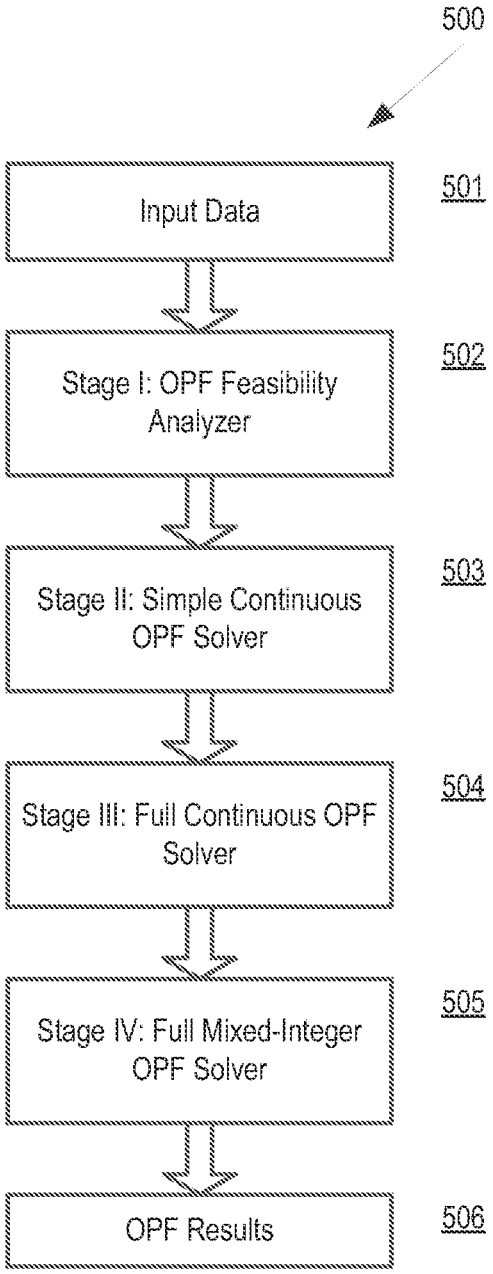
FIG. 5 illustrates a multi-staged SuperOPF process according to one embodiment.

The SuperOPF process. The SuperOPF-VS process 400 combines a SuperOPF process and a VS process. FIG. 5 illustrates a multi-stage SuperOPF process 500 for computing a full OPF solution according to an embodiment. The process 500 includes the following stages. Given an input data (501), an OPF solution is computed where the objective function specified by the user is to be minimized or maximized, while all the operational and physical limits are satisfied.

Stage I of SuperOPF: OPF Feasibility Analyzer (502), also referred to as a constraint analyzer. Practical large systems are vulnerable to data or parameter errors, which may result in infeasible OPF problems and cause the OPF solver to diverge. An OPF problem is feasible if there exists at least one point that satisfies all of the constraints simultaneously. Conversely, an OPF problem is infeasible if there does not exist any point that satisfies all of the constraints simultaneously. Generally, using a feasible point as the initial point can usually improve the convergence property of the OPF solver. Therefore, the SuperOPF process 500 incorporates a dedicated and automatic feasibility analyzer to correct infeasible configurations and provide a feasible initial point for the OPF solver.

Stage II of SuperOPF: Simple Continuous OPF Solver (503). The OPF problem in its general form (1) is a high-dimension, nonlinear and nonconvex optimization problem. Nonlinearity and nonconvexity of the OPF problem come from both the objective to optimize and constraints to be satisfied by the solution. Studies reported in literature and industrial practices have shown that it is a very challenging task to compute an optimal solution to the full OPF problem (1) in a robust, reliable and efficient manner. However, if a good initial point can be provided, a solution to the OPF problem (1) can still be effectively obtained using existing numerical optimization methods, such as the interior point method (IPM), sequential quadratic programming (SQP), and trust-region (TR) based methods. Therefore, instead of solving the OPF problem (1) directly, a simple OPF problem is solved in this stage to obtain an initial point. As an example, this simple OPF problem is a linearized direct current (DC) OPF problem according to one embodiment, where both nonlinear objective and constrained functions are linearized to compute an approximate solution to the full OPF problem (1). As another example, this simple OPF problem is a convex optimization problem according to one embodiment. Yet as another example, this simple OPF problem is a reduced nonlinear OPF problem according to one embodiment, where part of the nonlinear constraints is removed from computation to compute an approximate solution to the full OPF problem (1).

Stage III of SuperOPF: Full Continuous OPF Solver (504). Using the approximate solution that is obtained in Stage II 503 as the initial point, the full OPF problem (1) can now be solved. As an example, this full OPF problem is solved using existing numerical optimization methods using the approximate solution as the initial point according to one embodiment, where the numerical methods can be the IPM, SQP and TR methods. As another example, the full OPF problem is solved using a homotopy continuation method according to one embodiment, where the simple OPF problem and the approximate solution obtained in Stage II 503 is used as the starting point of the homotopy process.

Homotopy methods have made important contributions toward the numerical solutions of general nonlinear equations. Homotopy methods are useful for solving difficult problems for which a good starting point close to a desired solution is hard to obtain. To solve a "difficult" problem $F(x)=0$, $F:R^n \rightarrow R^n$, one can devise an appropriate "easy" problem $G(x)=0$, $G:R^n \rightarrow R^n$, which is easier to solve or has one or more known solutions. Homotopy methods entail embedding a continuation parameter $\lambda$ into the "difficult" problem $F(x)=0$ to form a higher-dimensional set of nonlinear equations:

$$H(x,\lambda):R^n \times R \rightarrow R^n, x \in R^n, \lambda \in R,$$

which satisfies the following boundary conditions:

1) $H(x, 0)=G(x)$, and
2) $H(x, 1)=F(x)$.

The homotopy function $H(x, \lambda)$ represents a set of n nonlinear equations with n+1 unknowns. From a computational viewpoint, homotopy methods can be viewed as tracing an implicitly defined curve $C(\lambda) \in H^{-1}(0)$ (through a solution space) from a starting point, say $(\bar{x}, 0)$ where $\bar{x}$ is a solution of the easy problem $H(x, 0)=0$, to an unknown solution of $H(x, 1)=0$. If the procedure succeeds, then a solution of $F(x)=0$ is obtained.

As an example, the homotopy process can be implemented as the fixed-point homotopy according to one embodiment. As another example, the homotopy process can be implemented as the Newton homotopy according to one embodiment.

Stage IV of SuperOPF: Full Mixed-Integer OPF Solver (505). There are many control components or devices, such as tap changing and phase shifting transformers, switchable shunt capacitors, etc., in an electric power system that can only take discrete values selected from a set of allowable values. If the discreteness of these control variables is considered in the OPF formulation, the OPF problem becomes a mixed-integer nonlinear optimization problem (NLP) of the form (2) according to one embodiment.

$$\min_{x,y} f(x,y)$$

$$s \cdot t\, h(x,y)=0$$

$$g(x,y) \leq 0$$

$$x \in R^n, y \in Z^m$$

where, $x=(V, \theta, P^G, Q^G)$ is the vector of continuous variables and $y=(t, \varphi, b)$ is the vector of discrete variables.

Once all of the four stages have been completed, the OPF analysis results will be returned (506).

Figure 6:
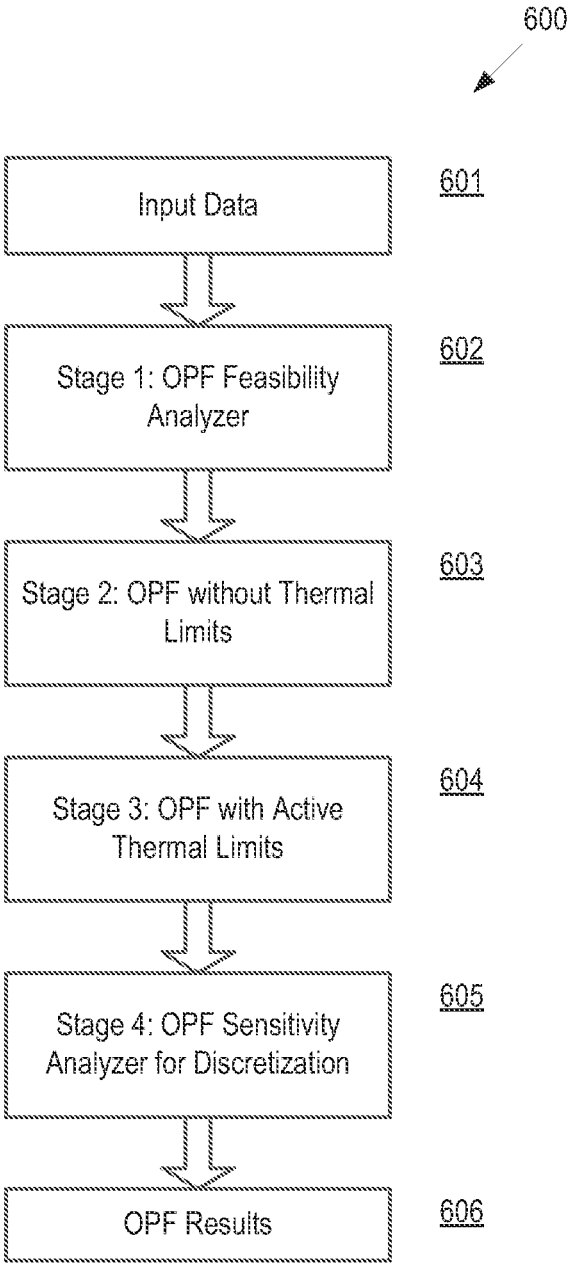
FIG. 6 illustrates an example of a SuperOPF process according to one embodiment.
Figure 7:
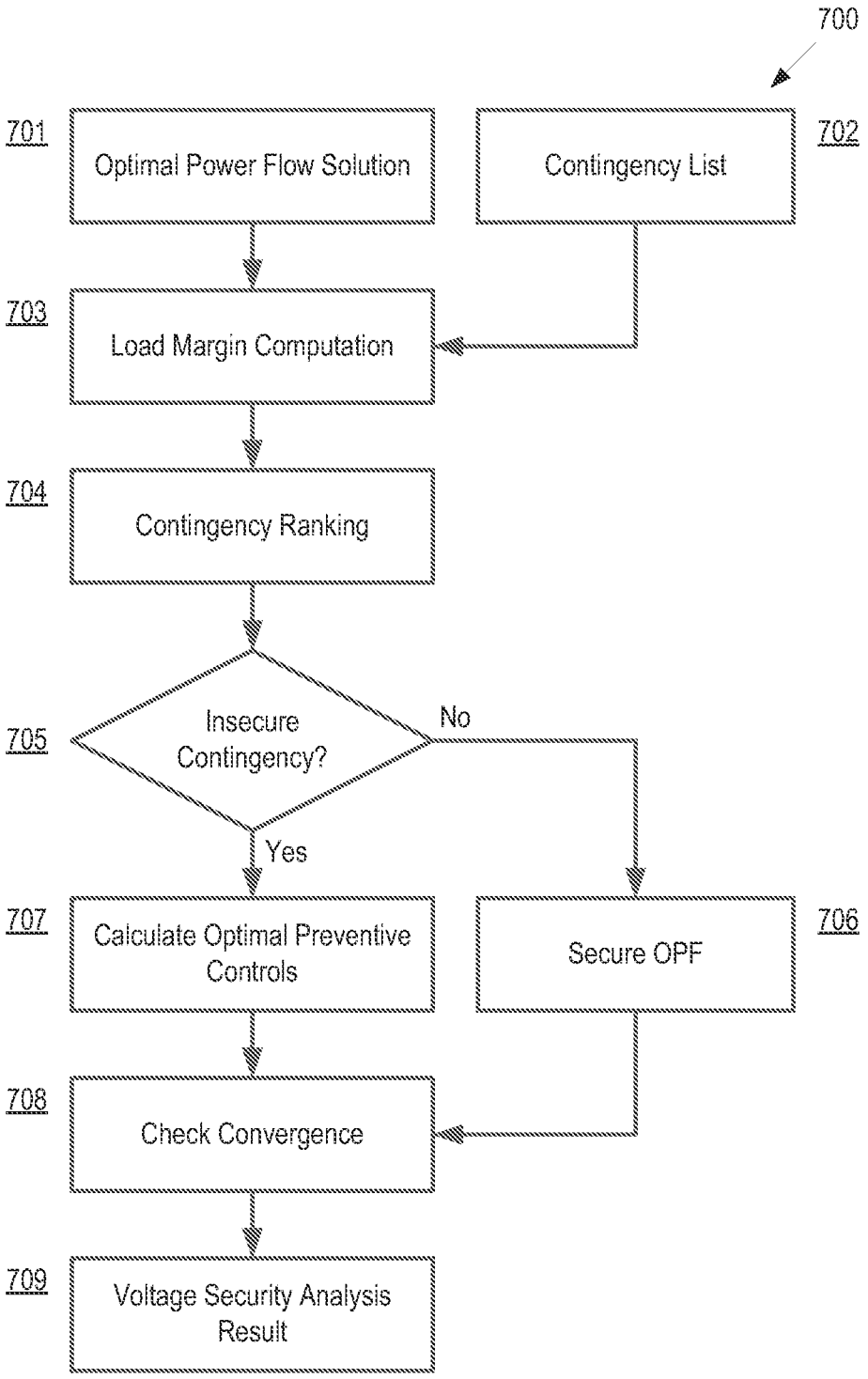
FIG. 7 illustrates an example of a VS process according to one embodiment.

Referring to FIG. 6, another embodiment of a SuperOPF process 600 is described as follows. Given an input data (601), an OPF solution is computed where the objective function specified by the user is to be minimized or maximized, while all the operational and physical limits are satisfied. As an example, the input data 601 may include the following data for initializing an OPF computation: 1) the state estimation case files that define the network topology and the initial operating states of the electric power system, and 2) the cost file that defines the cost models of the generation units of the electric power system. The cost model for a generation unit defines how the production cost varies as the generation output of the unit is changed.

In one embodiment, an OPF problem can be formulated as a constrained nonlinear optimization problem of the following form:

$$\min f(V,\theta,t,\varphi,b,P^G,Q^G)$$

$$s \cdot t \cdot P_i(V,\theta,t,\varphi,b)+P_i^L-P_i^G=0, i=1, \ldots, n_B$$

$$Q_i(V,\theta,t,\varphi,b)+Q_i^L-Q_i^G=0, i=1, \ldots, n_B$$

$$S_{ij}(V,\theta,t,\varphi,b) \leq (1+\lambda)\bar{S}_{ij}, (i,j) \in L_\alpha$$

$$S_{ji}(V,\theta,t,\varphi,b) \leq (1+\lambda)\bar{S}_{ij}, (i,j) \in L_\alpha$$

$$\underline{V}_i \leq V_i \leq \bar{V}_i, i=1, \ldots, n_B$$

$$\underline{t}_i \leq t_i \leq \bar{t}_i, i=1, \ldots, n_T$$

$$\underline{\varphi}_i \leq \varphi_i \leq \bar{\varphi}_i, i=1, \ldots, n_P$$

$$\underline{b}_i \leq b_i \leq \bar{b}_i, i=1, \ldots n_S$$

$$\underline{P}_j^G \leq P_j^G \leq \bar{P}_j^G, j=1, \ldots, n_G$$

$$\underline{Q}_j^G \leq Q_j^G \leq \bar{Q}_j^G, j=1, \ldots, n_G, \quad (3)$$

where, $V=[V_1, \ldots, V_{n_B}]^T$ is the vector of bus voltage amplitudes with lower bounds $\underline{V}$ and upper bounds $\bar{V}$, $\theta=[\theta_1, \ldots, \theta_{n_B}]^T$ the vector of bus voltage phase angles with lower bounds $\underline{\theta}$ and upper bounds $\bar{\theta}$, $t=[t_1, \ldots, t_{n_T}]^T$ is the vector of tap positions for tap-changing transformers with lower bounds $\underline{t}$ and upper bounds $\bar{t}$, and $(\varphi=[\varphi_1, \varphi_{n_P}]^T$ the vector positions for phase-shifting transformers with lower bounds $\underline{\varphi}$ and upper bounds $\bar{\varphi}$, $b=[b_1, \ldots, b_{n_S}]$ is the vector of positions for switchable shunts with lower bounds $\underline{b}$ and upper bounds $\bar{b}$, and $P^G=[P_{g1}, \ldots, P_{gn_G}]$ is the vector of real power outputs of generators with lower bounds $\underline{P}^G$ and upper bounds $\bar{P}^G$ and $Q^G=[Q_{g1}, \ldots, Q_{gn_G}]$ is the vector of reactive power outputs of generators with lower bounds $\underline{Q}^G$ and upper bounds $\bar{Q}^G \cdot P_i(V, \theta, t, \varphi, b)$ and $Q_i(V, \theta, t, \varphi, b)$ are the real and reactive power injections at the i-th bus in the system, respectively. $S_{ij}(V, \theta, t, \varphi, b)$ and $S_{ji}(V, \theta, t, \varphi, b)$ are the power flows transmitted through the branch connecting i-th and j-th buses, measured at the from-end (i-th bus) and the to-end (j-th) bus, respectively. S is a vector of the thermal limit imposed on the transmission lines (branches) in the system. Instead of solving the OPF problem (3) directly, the SuperOPF process 600 solves the OPF problem (3) in four stages.

Stage 1 of SuperOPF: OPF Feasibility Analyzer (602), also referred to as a constraint analyzer. In one embodiment, the first stage of the SuperOPF process 600 includes feasibility analysis of the constraints of the OPF problem (2). The goal of the constraint analyzer is twofold. For a feasible OPF problem, the constraint analyzer finds a feasible solution to the OPF problem first, which will be used as the initial point for the full OPF problem. For an infeasible OPF problem, the constraint analyzer determines why the OPF problem is infeasible and what the minimum effort (e.g., constraint relaxation) is to restore feasibility of the problem.

In order to figure out whether or not the OPF problem is feasible, an energy-minimizing problem is solved. In one embodiment, using the general formulation (1), the original nonlinear program of OPF is transformed to the energy minimization problem:

$$\begin{array}{ll} \min & f(x) \\ \text{s.t.} & h(x)=0 \\ & g(x) \leq 0 \\ & \underline{x} \leq x \leq \bar{x} \end{array} \Rightarrow \min_{x,s} E(x,s) = \left\| \begin{pmatrix} h(x) \\ g(x)-s_g^2 \\ x-\bar{x}+\bar{s}^2 \\ x-\underline{x}-\underline{s}^2 \end{pmatrix} \right\|^2 \quad (4)$$

where, $x=(V, \theta, t, \varphi, b, P_g, Q_g)^T$ is the vector of optimization variables, $s=(s_g, \bar{s}, \underline{s})^T$ is the vector of slack variables for equality and inequality constraint, and $E(x,s)$ is the energy function to be minimized. If there is a solution to (4) when the energy E(x,s) is 0, then the OPF problem is feasible and a feasible point is found; otherwise, the OPF problem is infeasible.

If the OPF problem is infeasible, the constraint analyzer determines why the OPF problem is infeasible and what the minimum effort (e.g., constraint relaxation) is to restore feasibility of the problem. To this end, in one embodiment, the constraint analyzer solves the following optimal constraint relaxation problem in the form of (5) to analyze the infeasibility and restore feasibility.

$$\begin{aligned} \min_{x,z} \quad & w^T z \\ \text{s.t.} \quad & h(x) = 0 \\ & g(x) \le z_g \\ & \underline{x} - z_x \le x \le \overline{x} + z_x \\ & z = (z_g, z_x) \ge 0 \end{aligned} \tag{5}$$

In the optimal constraint relaxation problem (5), w is the vector of predefined weights and z is the vector of relaxations to be imposed to the nonlinear inequality constraints $g(x) \le z_g$ and variable bounds $\underline{x} - z_x$ and $\overline{x} + z_x$. The flexibility of an adjustable constraint can be revealed by its weight value. More specifically, a large weight means the constraint is slightly flexible and its relaxation is expected to be small; a small weight means the constraint is quite flexible and its relaxation can have a wide range. The minimum energy point obtained by solving the energy-minimizing problem (4) is used as the initial point for the optimal constraint relaxation problem (5). The solution to the optimal constraint relaxation problem (5) is a set of new bounds for the constraints of the OPF problem. The new bounds can be used to restore feasibility of the OPF problem.

Stage 2 of SuperOPF: OPF without thermal limits (603). Thermal limit constraints are the source of nonlinear inequality constraints in the OPF problem (3) and are the most complicated nonlinear constraints in (3). To solve the OPF problem (3), conventional OPF methods usually consider all thermal limits at the same time. However, most of the thermal constraints are inactive throughout the computation; therefore, these inactive constraints do not contribute to the OPF problem (3). By involving inactive thermal limit constraints, it not only unnecessarily increases the problem complexity, but also makes the computation hard to converge or even diverge.

To take advantage of this property of the OPF problem, the SuperOPF process 600 first solves an OPF problem without considering thermal limit constraints. The OPF problem without thermal limit constraints is of the form (6) according to one embodiment. Compared to (3), the problem size of (6) is significantly reduced and the OPF computation can converge fast and more robustly, because nonlinear inequality constraints (that is, thermal limit constraints) are removed from the computation.

$$\begin{aligned} & \min f(V,\theta,t,\varphi,b,P^G,Q^G) \\ & s\cdot t\cdot P_i(V,\theta,t,\varphi,b)+P_i^L-P_i^G=0, i=1,\ldots,n_B \\ & Q_i(V,\theta,t,\varphi,b)+Q_i^L-Q_i^G=0, i=1,\ldots,n_B \\ & \underline{V_i} \le V_i \le \overline{V_i},\ i=1,\ldots,n_B \\ & \underline{t_i} \le t_i \le \overline{t_i}, i=1,\ldots,n_T \\ & \underline{\varphi_i} \le \varphi_i \le \overline{\varphi_i}, i=1,\ldots,n_P \\ & \underline{b_i} \le b_i \le \overline{b_i}, i=1,\ldots n_S \\ & \underline{P_j^G} \le P_j^G \le \overline{P_j^G}, j=1,\ldots,n_G \\ & \underline{Q_j^G} \le Q_j^G \le \overline{Q_j^G}, j=1,\ldots,n_G \end{aligned} \tag{6}$$

In the SuperOPF process 600, the feasible point obtained in Stage 1 of constraint analysis is used as the initial point for the OPF problem (6).

Stage 3 of SuperOPF: OPF with thermal limits (604). Usually, very few thermal limits are violated (e.g., less than 100 out of 20,000 branches) in the OPF solution without thermal limit constraints which is obtained in Stage 2. In Stage 3 of the SuperOPF process 600, thermal limit constraints are considered in the OPF problem but are handled in a homotopy manner.

The OPF problem to be solved in this stage is of the form (7) according to one embodiment.

$$\begin{aligned} & \min f(V,\theta,t,\varphi,b,P^G,Q^G) \\ & s\cdot t\cdot P_i(V,\theta,t,\varphi,b)+P_i^L-P_i^G=0, i=1,\ldots,n_B \\ & Q_i(V,\theta,t,\varphi,b)+Q_i^L-Q_i^G=0, i=1,\ldots,n_B \\ & S_{ij}(V,\theta,t,\varphi,b) \le (1+\lambda)\overline{S}_{ij}, (i,j)\epsilon L_\alpha \\ & S_{ji}(V,\theta,t,\varphi,b) \le (1+\lambda)\overline{S}_{ij}, (i,j)\epsilon L_\alpha \\ & \underline{V_i} \le V_i \le \overline{V_i},\ i=1,\ldots,n_B \\ & \underline{t_i} \le t_i \le \overline{t_i}, i=1,\ldots,n_T \\ & \underline{\varphi_i} \le \varphi_i \le \overline{\varphi_i}, i=1,\ldots,n_P \\ & \underline{b_i} \le b_i \le \overline{b_i}, i=1,\ldots n_S \\ & \underline{P_j^G} \le P_j^G \le \overline{P_j^G}, j=1,\ldots,n_G \\ & \underline{Q_j^G} \le Q_j^G \le \overline{Q_j^G}, j=1,\ldots,n_G \end{aligned} \tag{7}$$

In the OPF problem (7), only active thermal constraints are involved. Therefore, compared to the OPF problem (6) without thermal limit constraint, the problem complexity does not significantly increase. The homotopy parameter is decreased during the homotopy process. As an example, two homotopy iterations with $\lambda_1=0.55$ and $\lambda_2=0.0$ m can be sufficient to eliminate all thermal limit violations and obtain a solution to the full OPF problem (3).

In the SuperOPF process 600, the feasible point obtained in Stage 2 of the OPF problem without thermal limit constraints is used as the initial point for the OPF problem (7).

Stage 4 of SuperOPF: sensitivity analysis for discretization (605). In the SuperOPF process 600, a sensitivity-based procedure is used for determining values for discrete control variables. Using the OPF solution obtained in Stage 3, the sensitivity of the objective function to changes in discrete control variables can be evaluated as:

$$\begin{aligned} S_y^f &= \frac{\partial f}{\partial y} - \left(\frac{\partial g}{\partial y}\right)^T \left[\left(\frac{\partial g}{\partial x}\right)^T\right]^{-1} \frac{\partial f}{\partial x} \\ S_y^h &= \frac{\partial h}{\partial y} - \frac{\partial h}{\partial x}\left(\frac{\partial g}{\partial x}\right)^{-1} \frac{\partial g}{\partial y}, \end{aligned} \tag{8}$$

Based on these sensitivity values, merit functions $\eta_i^+$ and $\eta_i^-$ can be evaluated to indicate the effects of discretizing a discrete variable on the objective and constraints function values. In an embodiment of the SuperOPF process 600, the merit functions are evaluated following the formulation (9):

$$\eta_i^+ = w_f \Delta f_i^+ + \Sigma_{k=1}^{n_h} w_h \max[0, h_k(\hat{x}, \hat{y}) + \Delta h_{ki}^+]$$

$$\eta_i^- = w_f \Delta f_i^- - \Sigma_{k=1}^{n_h} w_h \max[0, h_k(\hat{x}, \hat{y}) - \Delta h_{ki}^-], \quad (9)$$

where $$\Delta f_i^+ = S_{y_i}^f (y_i^{j_i+1} - y_i^{j_i})$$

$$\Delta f_i^- = S_{y_i}^f (y_i^{j_i-1} - y_i^{j_i})$$

$$\Delta h_{k_i}^+ = S_{d_i}^{h_k} (d_i^{j_i+1} - d_i^{j_i}), \forall k = 1, \ldots n_h$$

$$\Delta h_{k_i}^- = S_{d_i}^{h_k} (d_i^{j_i+1} - d_i^{j_i}), \forall k = 1, \ldots n_h \quad (10)$$

are the linear estimate of changes of the objective function and inequality constraints. Using these merit function values, in Stage 4 of the SuperOPF process 600, the discrete control variables in the OPF problem (2) are determined through the following four steps according to one embodiment.

Step 1: Rank the discrete variables by an increasing order of merit function values. Therefore, the top ranked values are of least merit function values, which means the changes of corresponding discrete variables will introduce minimal changes to the objective and constraint function values.

Step 2: Pick the top ranked ones which have not been set yet to a discrete value and set it to its best discrete value.

Step 3: Update the inequality constraints by considering linearly the effect of changing the value of the top ranked discrete variables.

Step 4: If all discrete variables have been set to discrete values, stop; otherwise, go to Step 1.

Once all of the four stages have been completed, the OPF analysis results will be returned (606). The OPF analysis results produced by the SuperOPF processes 500 and 600 include, but are not limited to, one or more of the following values:

1) The optimal value of the objective function, such as the minimal system power losses, the minimal system production costs, the minimal system generation, the maximal system transfer capability, and the maximal system load margin.

2) The system operation states and power flows associated with optimal solution.

3) The optimal value of the discrete control variables of the power system.

As mentioned above, the SuperOPF-VS process 400 combines a SuperOPF process (such as the SuperOPF process 600) and a VS process. The VS process is to analyze voltage stability on a list of contingencies for the OPF solution and for computing optimal preventive control to eliminate or reduce insecure contingencies if there is any. In an embodiment of the SuperOPF-VS process 400, the VS process is performed by a voltage stability analyzer, e.g., a voltage stability analysis (VSA) program. Alternatively, the VS process may be implemented by hardware, or a combination of software and hardware. The VSA program is able to perform load margin computation on the base case system and on the contingencies. The VSA program is also able to compute an optimal set of preventive controls to remove one or more insecure contingencies, thus to enable the system to survive the occurrence of any of these contingencies. Referring to FIG. 6, in an embodiment of the present invention, a VS process 700 is implemented with a procedure comprising of the following steps.

Step 0: Inputs to the VS process 700 include the OPF solution (701) computed by the SuperOPF process 500 and a list of contingencies (702) to be analyzed on the electric power system. For the initial VS process (403) of FIG. 4, its input is a power flow solution (402) and the list of contingencies.

Step 1: Use the VSA program to compute the load margin (703) of the base case system, that is, the system running at states represented by the OPF solution (701). Use the VSA program also to compute or estimate the load margins (703) when each contingency in the list of contingencies (702) is applied to the system running at states represented by the OPF solution (701). For the initial VS process (403), the load margin of the base case system and the load margins with contingencies applied are computed for the system operating at states represented by the power flow solution (402).

Step 2: Use the VSA program, contingency ranking (704) is carried out on the list of contingencies (702). More specifically, the list of contingencies (702) is ranked based on their load margins computed in (703). In an embodiment of the SuperOPF-VS process 400, the contingencies are ranked in an ascending order in terms of their load margin values. Therefore, the top ranked contingencies are those contingences having negative or zero load margins. These contingencies with negative or zero (i.e., non-positive) load margins are insecure contingencies.

Step 3: Based on the contingency ranking (704), it is checked whether there is any insecure contingency in the list of contingencies (705). Therefore, security of the system running at states represented by the OPF solution is evaluated in terms of the list of contingencies.

Step 4: If there is no insecure contingency in the list of contingencies, then a secure OPF solution is obtained (706). In other words, the obtained OPF solution is not only optimal in terms of the desired objective, but also able to maintain voltage stability should any single contingency in the contingency list occur in the planning horizon. Go to step 6.

Step 5: If there is any insecure contingency in the contingency list, an optimal set of preventive controls (707) is computed by the VSA program. The preventive controls are computed to make the system secure, so as to eliminate or reduce the number of insecure contingencies. In an embodiment of the SuperOPF-VS process 400, the preventive controls can be applied by adjustments to control components, such as shunt capacitors, real and reactive power generations, restoring off-line shunt capacitors, load shedding, etc., in an electric power system such as the example shown in FIG. 1. Go to Step 6.

Step 6: Convergence of the procedure is checked (708). The stopping criteria are satisfied if one or more of the following condition is true: 1) the OPF solution is secure; that is, no insecure contingency is identified by the VS process 700, 2) the change of OPF objective is within a threshold and the list of insecure contingencies stay the same in two consecutive iterations, 3) the maximum number of iterations is reached. Go to Step 7.

Step 7: The VS process 700 returns the voltage stability analysis result (709). In an embodiment of the SuperOPF-VS process 400, the voltage stability analysis result includes, but is not limited to, one or more of the following: a determination on whether the system running at the states represented by the input OPF solution (701) is secure or not in terms of the input list of contingencies (702), the load margin values of the base case system and the contingencies, the set of optimal preventive controls to be applied to the system if there is any insecure contingency, and the post-control power flow solution.

Figure 8:
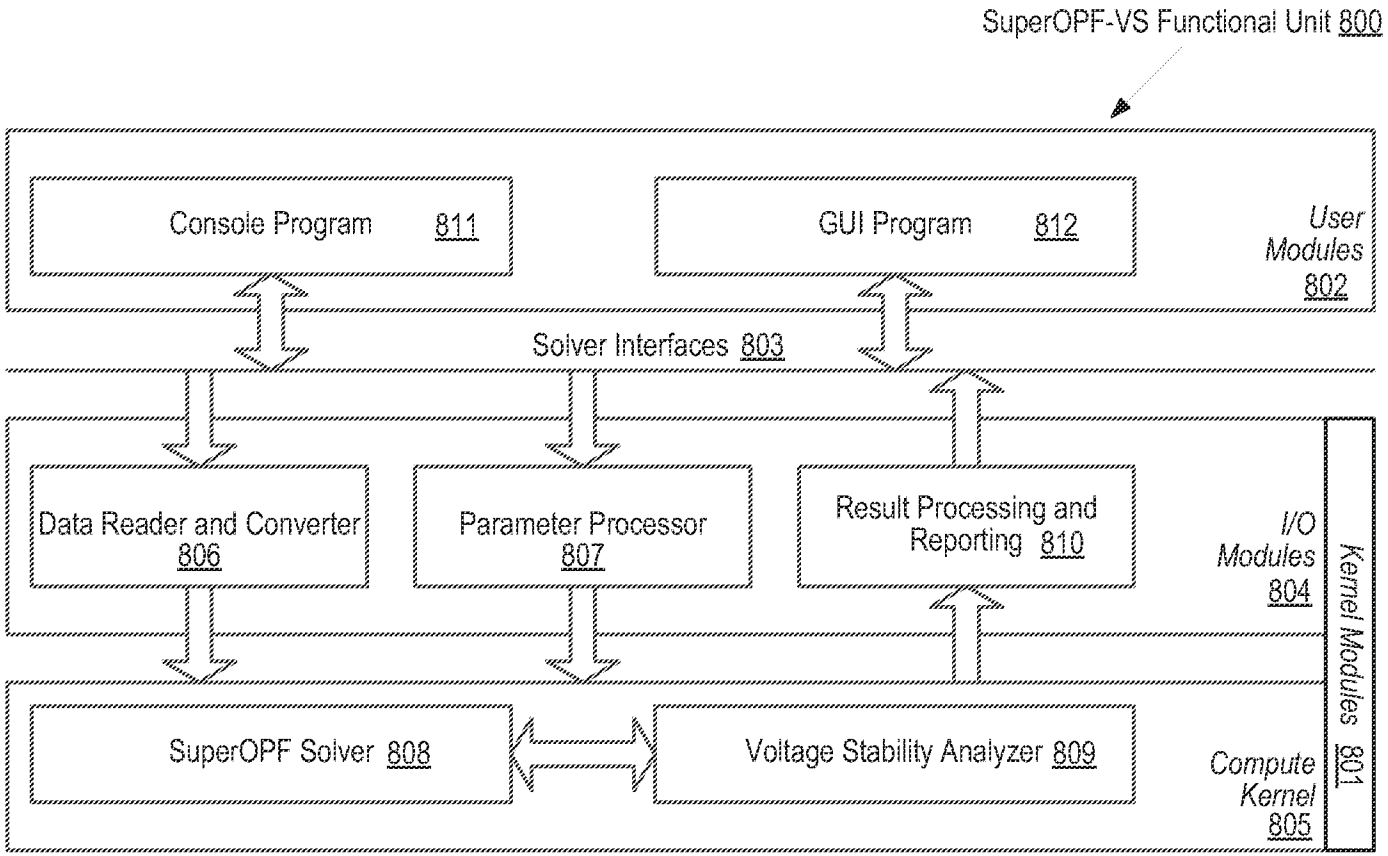
FIG. 8 is a diagram illustrating a SuperOPF-VS functional unit according to one embodiment.

FIG. 8 illustrates a block diagram of an embodiment of a voltage-security-assisted OPF functional unit (referred herein as the SuperOPF-VS functional unit 800) that performs the SuperOPF-VS process 400.

The SuperOPF-VS functional unit 800 has a modularized structure and is designed to be ready for future extensions. It is flexible and convenient for further development, in order to support more data formats and to enclose other effective linear and nonlinear solvers into the current implementation. As shown in FIG. 8, the functional unit 800 includes two major parts, that is, the kernel modules 801 and the user modules 802.

In one embodiment, the kernel modules 801 handle the computationally intensive and architecture independent tasks. These tasks mainly include data file reading, parameter setting, result presenting and writing, and SuperOPF-VS computations. The kernel modules 801 can be divided into two categories, namely, the I/O modules 804 and the compute kernel 805.

The I/O modules 804 handle the tasks of data file reading and converting required by the SuperOPF-VS functional unit 800, parameter settings for computation, and result presenting. In one embodiment, the I/O modules 804 include a data reader and converter 806 for reading power flow files and other data files. One important data file to be processed is the power flow file, where the structure of the power network under study, parameters of the involved network components, and the initial state of the power network are specified. There are many data formats used by different vendors and utilities in the power industry, among which PSS/E, PSLF, PSF, and CIM are the most popular ones. In one embodiment of the SuperOPF-VS functional unit 800, different power flow data I/O modules are implemented, each of which is dedicated to one data format. All these data I/O modules are derived from a power flow I/O base module. External power flow files in different formats are read and processed by the data reader and converter 806 and then converted to an internal, unified power network representation. In such a way, efforts for future support of other data formats can be minimized. The data reader and converter 806 implements the procedure of reading other data files following the same philosophy of flexibility and extensibility. The other data files to be processed by the SuperOPF-VS functional unit 800 include the generation cost model file for minimizing the system generation cost and the contingency related files for scenarios of OPF with security constraints. Another important data file for SuperOPF-VS functional unit 800 is the contingency list, which specifies the list of credible (N−1) contingences to be analyzed by the functional unit 800. In addition to the data reader and converter 806, the I/O modules 804 also includes a parameter processor 807 for handling parameter settings, which interprets the user configured parameters and converts them to internal representations understandable by the compute kernel 805. The I/O modules 804 also includes a result processing and reporting module 810 for result data representation, which interprets and archives the output files produced by the compute kernel 805 and to produce reports of the computational results.

The actual optimal power flow computation and voltage stability analysis are handled by the compute kernel 805. All the data collected and processed by the data reader and converter 806 and computation parameters processed by the parameter processor 807 are fed to the compute kernel 805 for the SuperOPF-VS computation. The SuperOPF-VS compute kernel 805 is composed of a SuperOPF solver 808 and a voltage stability analyzer 809. The computation results by the two modules 808 and 809 are exchanged and updated in an iterative manner, so as to produce a secure OPF solution.

The SuperOPF-VS functional unit 800 has the flexibility to support different effective solvers, such as the interior point method (IPM) solver and the sequential quadratic programming (SQP) solver. To this end, the central part of the compute kernel 805 is the OPF solver base module, where the general nonlinear program (NLP) modeling and solver calling are implemented. All solver modules for realizing specific optimization methods or optimizers are derived from this OPF solver base module. In one embodiment, the kernel modules 801 are implemented in a programming language (e.g., C++) using only standard, architecture independent libraries. Therefore, the kernel modules 801 can easily be ported to different hardware architectures and operation systems with minimum efforts.

In one embodiment, the SuperOPF-VS functional unit 800 includes solver interfaces 803 that are developed using operation system dependent libraries, which provide natively-supported and convenient resources for realizing a user-friendly and feature-rich graphical user interface (GUI) on the target operation system environment for the SuperOPF-VS functional unit 800.

In one embodiment, the user modules 802 include two components. The first component is a GUI program 812. This GUI program 812 provides users a convenient and feature-enriched interface to interact with the underlying OPF computation. The GUI program 812 includes a data selection and display part, a parameter and model setting part, and a resulting reporting part. The first part, that is, the data selection and display part handles the task of selecting required data file paths for the OPF computation. As an example, usual data files for OPF computation include the power flow file and generation cost file (when the OPF objective is to minimize the system generation cost). The selected data files can be displayed by the GUI program 812 in an organized way and can be easily reviewed or modified by the user. The second part of the GUI program 812 is for parameter and model settings. Responsive interfaces are designed for the user to set up a desired OPF computation scenario by specifying the problem model (the optimization objective, the cost model, etc.) and editing computation parameters (the optimization strategy, the optimizer to use, the detailed optimization parameters, etc.). Therefore, the user has a full control over the computation to be performed. The third part handles the result reporting. Taking advantage of existing reporting engines, e.g., the Microsoft® Reports, feature-enriched and meaningful is representations of the OPF computation results can be automatically produced and reported to the target user.

In addition to or instead of the GUI program 812, a console program 813 may be included in an embodiment of the SuperOPF-VS functional unit 800. This console program 813 can be run in a command line environment. However, the user still has full control over the computation scenarios through specifying the parameters to the SuperOPF-VS console command. This results in a stand-alone, lightweight SuperOPF-VS functional unit 800 suitable for low-end hardware environments. Moreover, such command-line based execution of the SuperOPF-VS computation provides the user a convenient way to effectively cooperate with other computation and management programs. For example, the user can include the call of the console program 813 in a script to automate the user's analysis tasks of sequential execution of multiple programs or the task of analyzing a batch of scenarios.

As examples, the SuperOPF-VS process 400 has been applied to carry out voltage-stability-assisted optimal power flow on two large-scale electric power systems. The SuperOPF-VS process computes a voltage-stable OPF solution with the objective to minimize the system real power loss. Although specific systems, parameter settings, components, objective, and result data are described in the following examples, it is understood that the systems, parameter settings, components, objective, and result data are illustrative and not limiting. Different systems, parameter settings, components, objective may be used and different result data may be obtained by the SuperOPF-VS process 400.

Experimental Results on a 6354-bus System. The SuperOPF-VS process 400 is first applied to a 6354-bus electric power system. The input data, including the initial power flow solution on the study system and parameter settings and optional auxiliary data such as generation cost model parameters, is fed to the SuperOPF-VS process 400. The study electric power system consists of 6534 buses, 2901 loads, 1903 generators, 8295 branches, 294 transformers, and 520 switched shunts.

A list of 1062 contingencies in one area of the study system is generated for voltage stability analysis. The 1062 contingencies are applied to the system according to the (N−1) security contingency standard. The VS process 700 is first carried out on the initial power flow. The associated system real power loss is computed and the list of 1062 contingencies is analyzed for the system running states represented by the initial power flow solution. Result shows that the system real power loss is 3793.6 MW and the load margin of the base case system is 3010 MW. The VS process 700 also reveals that there are seven insecure contingencies. In other words, the system is not secure enough to sustain the occurrence of any of these seven insecure contingencies.

The SuperOPF process 600 is then applied to the system using the initial power flow as the initial condition. Stage I of OPF constraint analyzer first analyzes feasibility of the constraints imposed on the system, and computes a feasible point with all constraints satisfied if the study system is feasible or to compute a restored feasible point with an optimal constraint relaxation if the study system is infeasible.

Using the feasible solution obtained by the constraint analyzer as the initial point, Stage II of an OPF without considering thermal limit constraints is then carried out on the study system. The Stage II OPF problem without thermal limit constraints has 12868 optimization variables which consists of voltage phase angles and magnitudes at all buses, real and reactive power generation by all generators with adjustable outputs, transformer tap ratios, phase shifter angles and all switchable shunts, 12085 equality constraints which consist of one linear equality constraint (fixed slack bus voltage phase angle) and 12084 nonlinear equality constraints (power flow balance constraints), and 13652 inequality constraints which consist of 13652 linear inequality constraints (lower and upper bounds on optimization variables) and zero nonlinear inequality constraints (thermal limit constraints).

Using the OPF solution obtained in Stage II as the initial point, Stage III of an OPF with active thermal limit constraint is then carried out on the study system. The Stage III OPF problem with active thermal limit constraints has 12868 optimization variables which consists of voltage phase angles and magnitudes at all buses, real and reactive power generation by all generators with adjustable outputs, transformer tap ratios, phase shifter angles and all switchable shunts, 12085 equality constraints which consist of one linear equality constraint (fixed slack bus voltage phase angle) and 12084 nonlinear equality constraints (power flow balance constraints), and larger than 13652 inequality constraints which consist of 13652 linear inequality constraints (lower and upper bounds on optimization variables) and a varying number of nonlinear inequality constraints (active thermal limit constraints, which are usually less than 100). All physically discrete optimization variables, including transformer tap ratios, phase shifter angles and switchable shunts, are treated as continuous variables in Stages I through III.

Using the OPF solution obtained in Stage III as the initial point, Stage IV of OPF sensitivity analyzer for discretization is then carried out to determine discrete values for the involved discrete variables. Among the set of optimization variables, there are 12054 physically continuous variables and 814 physically discrete variables. After all discrete variables have been assigned to their optimal allowable operation positions, the final OPF solution is ready to be fed to voltage stability analyzer for voltage stability analysis.

The SuperOPF process 600 converges in 49 iterations. The resulted optimal power flow solution drives the system real power loss down to 1642.8 MW. The VS process is carried out to analyze the list of 1062 contingencies on the system with running states represented by the resulted OPF solution. The VS process shows that the load margin of the base case system has been increased to 4840 MW and the number of insecure contingencies has been reduced to five. In other words, compared to the initial power flow, the optimal power flow solution drives the system more secure with increased base case load margin and decreased number of insecure contingencies. However, the system is still not secure enough to sustain the occurrence of any of these remained five insecure contingencies.

In order to make the system more secure, the VS process 700 calculates an optimal set of preventive controls and applies them to the system. The VS process 700 then analyzes the list of 1062 contingencies again on the system with running states represented by the modified OPF solution with the calculated set of preventive controls. The result of the VS process 700 shows that the load margin of the base case system stays at 4840 MW and all those five remained insecure contingencies has been eliminated. In the meantime, the system real power loss has been slightly increased to 1674.6 MW. In other words, the system with running states represented by the OPF solution with preventive controls is sufficiently secure to sustain the occurrence of any of the 1062 contingencies in the contingency list.

Experimental Results on a 13183-bus System. The SuperOPF-VS process 400 is also applied to a 13183-bus electric power system. The input data, including the initial power flow solution on the study system and parameter settings and optional auxiliary data such as generation cost model parameters, is fed to the SuperOPF-VS process 400. The study electric power system consists of 13183 buses, 9691 loads, 2304 generators, 18168 branches, 1410 transformers, and 1404 switched shunts.

A list of 6894 contingencies in the whole study system is generated for voltage stability analysis. The 6894 contingencies are applied to the system according to the (N−1) security contingency standard. The VS process 700 is first carried out on the initial power flow. The associated system real power loss is computed and the list of 6894 contingencies is analyzed for the system running states represented by the initial power flow solution. Result shows that the system real power loss is 5589.3 MW and the load margin of the base case system is 4901 MW. The VS process 700 also reveals that there are sixteen insecure contingencies. In other words, the power system is not secure enough to sustain the occurrence of any of these sixteen insecure contingencies.

The SuperOPF process 600 is then applied to the system using the initial power flow as the initial condition. Stage I of OPF constraint analyzer first analyzes feasibility of the constraints imposed on the system, and computes a feasible point with all constraints are satisfied if the study system is feasible or to compute a restored feasible point with an optimal constraint relaxation if the study system is infeasible. Using the feasible solution obtained by constraint analyzer as the initial point, Stage II of an OPF without considering thermal limit constraints is then carried out on the study system. The Stage II OPF problem without thermal limit constraints has 31134 optimization variables which consists of voltage phase angles and magnitudes at all buses, real and reactive power generation by all generators with adjustable outputs, transformer tap ratios, phase shifter angles and all switchable shunts, 26367 equality constraints which consist of one linear equality constraint (fixed slack bus voltage phase angle) and 26366 nonlinear equality constraints (power flow balance constraints), and 35902 inequality constraints which consist of 35902 linear inequality constraints (lower and upper bounds on optimization variables) and zero nonlinear inequality constraints (thermal limit constraints).

Using the OPF solution obtained by Stage II as the initial point, Stage III of an OPF with active thermal limit constraint is then carried out on the study system. The Stage III OPF problem with active thermal limit constraints has 31134 optimization variables which consists of voltage phase angles and magnitudes at all buses, real and reactive power generation by all generators with adjustable outputs, transformer tap ratios, phase shifter angles and all switchable shunts, 26367 equality constraints which consist of 1 linear equality constraint (fixed slack bus voltage phase angle) and 26366 nonlinear equality constraints (power flow balance constraints), and larger than 35902 inequality constraints which consist of 35902 linear inequality constraints (lower and upper bounds on optimization variables) and a varying number of nonlinear inequality constraints (active thermal limit constraints, which are usually less than 100). All physically discrete optimization variables, including transformer tap ratios, phase shifter angles and switchable shunts, are treated as continuous variables in Stage I through III.

Using the OPF solution obtained in Stage III as the initial point, Stage IV of OPF sensitivity analyzer for discretization is then carried out to determine discrete values for the involved discrete variables. Among the set of optimization variables, there are 28320 physically continuous variables and 2814 physically discrete variables. After all discrete variables have been assigned to their optimal allowable operation positions, the final OPF solution is ready to be fed to voltage stability analyzer for voltage stability analysis.

The SuperOPF process 600 converges in 306 iterations. The resulted optimal power flow solution drives the system real power loss down to 3293.0 MW. The VS process 700 is carried out to analyze the list of 6894 contingencies on the system with running states represented by the resulted OPF solution. The result of the VS process 700 shows that the load margin of the base case system has been decreased to 4306 MW and the number of insecure contingencies has been reduced to nine. In other words, compared to the initial power flow, the optimal power flow solution drives the system more secure with decreased number of insecure contingencies, though the base case load margin is slightly decreased. However, the system is still not secure enough to sustain the occurrence of any of these remained nine insecure contingencies.

In order to make the system more secure, the VS process 700 calculates an optimal set of preventive controls and applies them to the system. The VS process 700 then analyzes the list of 6894 contingencies again on the system with running states represented by the modified OPF solution with the calculated set of preventive controls. The VS process 700 shows that the load margin of the base case system is slightly decreased to 4299 MW and eight among the nine insecure contingencies have been eliminated. In the meantime, the system real power loss has been slightly increased to 3293.8 MW. In other words, the system with running states represented by the optimal power flow solution with preventive controls is sufficiently secure to sustain the occurrence of any of the 6893 contingencies in the contingency list. Other effective preventive controls may be designed in order to eliminate the remaining one insecure contingency; or the remaining one contingency is not credible in that the possibility for its occurrence is sufficiently low to be excluded from routine analysis.

Embodiments of the techniques disclosed herein may be implemented in hardware, software, firmware, or a combination of such implementation approaches. In one embodiment, the methods described herein may be performed by a processing system. A processing system includes any system that has a processor, such as, for example; a digital signal processor (DSP), a microcontroller, an application specific integrated circuit (ASIC), or a microprocessor. One example of a processing system is a computer system.

Referring back to FIG. 2, the computer system 200 may be a server computer, or any machine capable of executing a set of instructions (sequential or otherwise) that specify actions to be taken by that machine. While only a single machine is illustrated, the term "machine" shall also be taken to include any collection of machines (e.g., computers) that individually or jointly execute a set (or multiple sets) of instructions to perform any one or more of the methodologies discussed herein.

The computer system 200 includes a processing device 202. The processing device 202 represents one or more general-purpose processors, or one or more special-purpose processors, or any combination of general-purpose and special-purpose processors. In one embodiment, the processing device 202 is adapted to execute the operations of the SuperOPF-VS function unit 800 of FIG. 8, which performs the methods and/or processes described in connection with FIGS. 3-6 for generating a secure OPF solution.

In one embodiment, the processor device 202 is coupled, via one or more buses or interconnects 230, to one or more memory devices such as: a main memory 204 (e.g., read-only memory (ROM), flash memory, dynamic random access memory (DRAM), a secondary memory 218 (e.g., a magnetic data storage device, an optical magnetic data storage device, etc.), and other forms of computer-readable media, which communicate with each other via a bus or interconnect. The memory devices may also different forms of read-only memories (ROMs), different forms of random access memories (RAMs), static random access memory (SRAM), or any type of media suitable for storing electronic instructions. In one embodiment, the memory devices may store the code and data of the SuperOPF-VS function unit 800. In the embodiment of FIG. 2, the SuperOPF-VS function unit 800 may be located in one or more of the locations shown as dotted boxes and labeled by the reference numeral 800.

The computer system 200 may further include a network interface device 208. A part or all of the data and code of the SuperOPF-VS function unit 800 may be transmitted or received over a network 220 via the network interface device 208. Although not shown in FIG. 2, the computer system 200 also may include user input/output devices (e.g., a keyboard, a touchscreen, speakers, and/or a display).

In one embodiment, the SuperOPF-VS function unit 800 can be implemented using code and data stored and executed on one or more computer systems (e.g., the computer system 200). Such computer systems store and transmit (internally and/or with other electronic devices over a network) code (composed of software instructions) and data using computer-readable media, such as non-transitory tangible computer-readable media (e.g., computer-readable storage media such as magnetic disks; optical disks; read only memory; flash memory devices as shown in FIG. 2 as 204 and 218) and transitory computer-readable transmission media (e.g., electrical, optical, acoustical or other form of propagated signals—such as carrier waves, infrared signals). A non-transitory computer-readable medium of a given computer system typically stores instructions for execution on one or more processors of that computer system. One or more parts of an embodiment of the invention may be implemented using different combinations of software, firmware, and/or hardware.

The operations of the methods and/or processes of FIG. 3-7 have been described with reference to the exemplary embodiment of FIG. 2. However, it should be understood that the operations of the methods and/or processes of FIG. 3-7 can be performed by embodiments of the invention other than those discussed with reference to FIG. 2, and the embodiment discussed with reference to FIG. 2 can perform operations different from those discussed with reference to the methods and/or processes of FIG. 3-7. While the methods and/or processes of FIG. 3-7 show a particular order of operations performed by certain embodiments of the invention, it should be understood that such order is exemplary (e.g., alternative embodiments may perform the operations in a different order, combine certain operations, overlap certain operations, etc.).

While the invention has been described in terms of several embodiments, those skilled in the art will recognize that the invention is not limited to the embodiments described, and can be practiced with modification and alteration within the spirit and scope of the appended claims. The description is thus to be regarded as illustrative instead of limiting.

What is claimed is:

1. A computer-implemented method for operating an electric power system subject to constraints imposed on the electric power system, the method comprising the steps of:

receiving input specifying characteristics and an initial state of the electric power system;

computing, based on the input, a secure optimal power flow (OPF) solution which optimizes an objective function of operating the electric power system subject to the constraints, wherein the objective function and the constraints are formulated as a security-constrained OPF problem, the computing further comprising:

(a) determining feasibility of the security-constrained OPF problem by minimizing a value of an energy function that is constructed from the constraints and bounds of state and control variables of the electric power system;

(b) restoring feasibility of the security-constrained OPF problem in response to a determination that the security-constrained OPF problem is infeasible;

(c) solving the security-constrained OPF problem; and (d) determining optimal values of discrete control variables for configuring physical control components in the electric power system;

performing voltage stability analysis on results of computing the secure OPF solution wherein the results including at least an optimal value of the objective function and the optimal values of the discrete control variables; and applying a set of preventive controls to the electric power system in response to a determination by the voltage stability analysis that there is at least an insecure contingency in the electric power system.

2. The method of claim 1, wherein the step (b) further comprises the steps of:

obtaining a minimum energy point from minimizing the value of the energy function; and using the minimum energy point as an initial point for solving an optimal constraint relaxation problem to obtain new bounds for the constraints of the security-constrained OPF problem.

3. The method of claim 1, further comprising the steps of:

determining the security-constrained OPF problem as feasible if the value of the energy function is minimized to zero within a predefined numerical tolerance; and determining the security-constrained OPF problem as infeasible if the value of the energy function cannot be minimized to zero within the predefined numerical tolerance.

4. The method of claim 1, wherein the step (c) further comprises the steps of:

computing the secure OPF solution without incorporating thermal limit constraints to obtain an initial point; and computing the secure OPF solution using the initial point under active thermal limit constraints.

5. The method of claim 4, wherein computing the secure OPF solution under the active thermal limit constraints further comprising: performing an iterative homotopy process to compute the secure OPF solution.

6. The method of claim 1, wherein the step (d) further comprises the steps of:

evaluating first sensitivity of the objective function with respect to changes to the discrete control variables;

evaluating second sensitivity of the constraints with respect to the changes to the discrete control variables; and determining the optimal values of the discrete control variables based on the first sensitivity and the second sensitivity.

7. The method of claim 1, wherein the step (c) further comprises: solving a mixed-integer nonlinear optimization problem.

8. A system adapted to operate an electric power system subject to constraints imposed on the electric power system, the system comprising:

a memory to store input which specifies characteristics and an initial state of the electric power system; and one or more processors coupled to the memory, the one or more processors adapted to:

compute, based on the input, a secure optimal power flow (OPF) solution which optimizes an objective function of operating the electric power system subject to the constraints, wherein the objective function and the constraints are formulated as a security-constrained OPF problem, the one or more processors further operative to:

(a) determine feasibility of the security-constrained OPF problem by minimizing a value of an energy function that is constructed from the constraints and bounds of state and control variables of the electric power system;

(b) restore feasibility of the security-constrained OPF problem in response to a determination that the security-constrained OPF problem is infeasible;

(c) solve the security-constrained OPF problem; and (d) determine optimal values of discrete control variables for configuring physical control components in the electric power system;

perform voltage stability analysis on results of computing the secure OPF solution wherein the results including at least an optimal value of the objective function and the optimal values of the discrete control variables; and apply a set of preventive controls to the electric power system in response to a determination by the voltage stability analysis that there is at least an insecure contingency in the electric power system.

9. The system of claim 8, when determining whether the system has any feasible solution, the one or more processors are further adapted to:

determine the security-constrained OPF problem as feasible if the value of the energy function is minimized to zero within a predefined numerical tolerance; and determine the security-constrained OPF problem as infeasible if the value of the energy function cannot be minimized to zero within a predefined numerical tolerance.

10. The system of claim 8, when restoring the feasibility, the one or more processors are further adapted to:

obtain a minimum energy point from minimizing the value of the energy function; and use the minimum energy point as an initial point for solving an optimal constraint relaxation problem to obtain new bounds for the constraints of the security-constrained OPF problem.

11. The system of claim 8, when solving the security-constrained OPF problem, the one or more processors are further adapted to:

compute the OPF solution without incorporating thermal limit constraints to obtain an initial point; and compute the OPF solution using the initial point under active thermal limit constraints.

12. The system of claim 11, wherein the one or more processors when computing the secure OPF solution under the active thermal limit constraints are further operative to: perform an iterative homotopy process to compute the secure OPF solution.

13. The system of claim 8, when determining the values of discrete control variables, the one or more processors are further adapted to:

evaluate first sensitivity of the objective function with respect to changes to the discrete control variables;

evaluate second sensitivity of the constraints with respect to changes to the discrete control variables; and determine the optimal values of the discrete control variables based on the first sensitivity and the second sensitivity.

14. The system of claim 8, wherein the security-constrained OPF problem comprises a mixed-integer nonlinear optimization problem.

15. A non-transitory computer readable storage medium including instructions that, when executed by a processing system, cause the processing system to perform a method for operating an electric power system subject to constraints imposed on the electric power system, the method comprising the steps of:

receiving input specifying characteristics and an initial state of the electric power system;

computing, based on the input, a secure optimal power flow (OPF) solution which optimizes an objective function of operating the electric power system subject to the constraints, wherein the objective function and the constraints are formulated as a security-constrained OPF problem, the computing further comprising:

(a) determining feasibility of the security constrained OPF problem by minimizing a value of an energy function that is constructed from the constraints and bounds of state and control variables of the electric power system;

(b) restoring feasibility of the security constrained OPF problem in response to a determination that the security-constrained OPF problem is infeasible;

(c) solving the security-constrained OPF problem; and (d) determining values of discrete control variables for configuring physical control components in the electric power system;

performing voltage stability analysis on results of computing the secure OPF solution wherein the results including at least an optimal value of the objective function and the optimal values of the discrete control variables; and applying a set of preventive controls to the electric power system in response to a determination by the voltage stability analysis that there is at least an insecure contingency in the electric power system.

16. The non-transitory computer readable storage medium of claim 15, wherein the step of solving further comprises the steps of:

determining the security-constrained OPF problem as feasible if the value of the energy function is minimized to zero within a predefined numerical tolerance; and determining the security-constrained OPF problem as infeasible if the value of the energy function cannot be minimized to zero within the predefined numerical tolerance.

17. The non-transitory computer readable storage medium of claim 15, wherein the step (b) further comprises the steps of:

obtain a minimum energy point from minimizing the value of the energy function; and using the minimum energy point as an initial point for solving an optimal constraint relaxation problem to obtain new bounds for the constraints of the security-constrained OPF problem.

18. The non-transitory computer readable storage medium of claim 15, wherein the step (c) further comprises the steps of:

computing the secure OPF solution without incorporating thermal limit constraints to obtain an initial point; and computing the secure OPF solution using the initial point under active thermal limit constraints.

19. The non-transitory computer readable storage medium of claim 15, wherein the step (d) further comprises the steps of:

evaluating first sensitivity of the objective function with respect to changes to the discrete control variables;

evaluating second sensitivity of the constraints with respect to changes to the discrete control variables; and determining the optimal values of the discrete control variables based on the first sensitivity and the second sensitivity.

20. The non-transitory computer readable storage medium of of claim 15, wherein the step (c) further comprises: solving a mixed-integer nonlinear optimization problem.

* * * * *